US009809914B2

(12) United States Patent
Kim et al.

(10) Patent No.: US 9,809,914 B2
(45) Date of Patent: Nov. 7, 2017

(54) CLOTHES TREATMENT APPARATUS

(71) Applicant: SAMSUNG ELECTRONICS CO., LTD., Suwon-si, Gyeonggi-do (KR)

(72) Inventors: Hyun Mook Kim, Osan-si (KR); Amitoj Singh, Haryana (IN); Sung Ah Kim, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 232 days.

(21) Appl. No.: 14/334,276

(22) Filed: Jul. 17, 2014

(65) Prior Publication Data

US 2015/0020556 A1 Jan. 22, 2015

(30) Foreign Application Priority Data

Jul. 18, 2013 (KR) ..... 10-2013-0084671

(51) Int. Cl.

| | |
|---|---|
| ***D06F 39/00*** | (2006.01) |
| ***D06F 29/00*** | (2006.01) |
| ***D06F 58/10*** | (2006.01) |
| ***D06F 58/20*** | (2006.01) |

(52) U.S. Cl.

CPC ..... *D06F 29/005* (2013.01); *D06F 39/008* (2013.01); *D06F 58/10* (2013.01); *D06F 58/203* (2013.01)

(58) Field of Classification Search

CPC ..... D06F 29/005

See application file for complete search history.

(56) References Cited

U.S. PATENT DOCUMENTS 4,972,687 A * 11/1990 Czech ..... D06F 29/00 68/20

2006/0201209 A1* 9/2006 Lee ..... D06F 25/00 68/5 C

* cited by examiner

*Primary Examiner* — Jason Ko

(74) *Attorney, Agent, or Firm* — Staas & Halsey LLP

(57) ABSTRACT

Disclosed is a clothes treatment apparatus including a washing apparatus including a cabinet having an opening formed at an upper side thereof and a door configured to open and close the opening to perform a washing process, and a drying apparatus including a drying chamber provided on at least one side surface of the cabinet to dry laundry, and a heated air generating part to introduce heated air to the drying chamber, so that a washing process and a drying process are simultaneously or separately controlled, thereby enhancing the clothes treatment efficiency.

13 Claims, 4 Drawing Sheets

CLOTHES TREATMENT APPARATUS

CROSS-REFERENCE TO RELATED APPLICATIONS

This application claims the benefit of Korean Patent Application No. 10-2013-0084671, filed on Jul. 18, 2013, in the Korean Intellectual Property Office, the disclosure of which is incorporated herein by reference.

BACKGROUND

1. Field

Embodiments of the present disclosure relate to a clothes treatment apparatus, and more particularly, to a clothes treatment apparatus provided with a drying function and a washing function.

2. Description of the Related Art

A washing apparatus represents an appliance that washes or dries laundry, such as clothes, and includes a washing machine and a laundry drying machine.

The washing machine is designed to remove dirt and contamination from laundry by using emulsification of detergent and making wash water and laundry contact with each other. In addition, the laundry drying machine is designed to dry laundry at a short period of time by supplying heated air to the laundry that is finished with washing, and used to dry a small amount of laundry.

However, such a conventional laundry drying machine performs a drying process while having clothes collectively loaded thereon, so that a tangled part of the bundle of clothes is not efficiently dried. In addition, there is a limitation in holding the laundry in the drying machine. In addition, a washing operation is not performed during a drying operation.

SUMMARY

Therefore, it is an aspect to provide a clothes treatment apparatus having a drying function separated from a washing function.

It is an aspect to provide a clothes treatment apparatus capable of performing steam sterilization on laundry through a steam function.

Additional aspects will be set forth in part in the description which follows and, in part, will be obvious from the description, or may be learned by practice of the disclosure.

In accordance with one aspect, a clothes treatment apparatus includes a washing apparatus and a drying apparatus. The washing apparatus may include a cabinet having an opening formed at an upper side thereof, a door configured to open and close the opening, a fixed tub provided in the cabinet to store wash water and a rotary tub rotatably provided in the fixed tub to accommodate laundry therein, to perform a washing process. The drying apparatus may include a drying chamber provided on at least one side surface of the cabinet to dry laundry, and a heated air generating part to introduce heated air to the drying chamber, the drying apparatus integrally formed with the washing apparatus.

The washing apparatus may be independently controlled from the drying apparatus.

The drying apparatus may include an opening/closing part rotatably provided on the cabinet to form the drying chamber by opening and closing thereof.

The opening/closing part may be formed to cover the one side surface of the cabinet.

The opening/closing part may include a main cover part and separate cover parts. The main cover part may be provided to face the one side surface of the cabinet. The spaced cover parts may be bent from both sides of the main cover part toward the cabinet.

The opening/closing part may be open and closed separately from the door.

The heated air generating part may be provided in the cabinet.

The clothes treatment apparatus may further include a steam generating part and a steam divergence part. The steam generating part may be provided in the cabinet to generate steam. The steam divergence part may allow the steam generated from the steam generating part to be selectively supplied to one of the washing apparatus and the drying chamber.

The drying apparatus may include a chamber inlet and a chamber outlet. The chamber inlet may be provided at a lower side of the drying chamber to allow heated air or steam to be introduced to the drying chamber. The chamber outlet may be provided at the opening/closing part to discharge the heated air or steam that is introduced through the chamber inlet to the outside.

The drying apparatus may include a drying duct connecting the heated air generating part to the drying chamber.

The drying chamber may be formed by the opening/closing part and the one side surface of the cabinet.

The drying chamber may be divided by the cabinet from a washing space in which a washing operation is performed by the washing apparatus.

In accordance with an aspect, a clothes treatment apparatus includes a washing apparatus and a drying apparatus. The washing apparatus includes a cabinet having an opening formed at an upper side thereof, a door configured to open and close the opening, a fixed tub provided in the cabinet to store wash water and a rotary tub rotatably provided in the fixed tub to accommodate laundry therein. The drying apparatus may include an opening/closing part rotatably coupled to the cabinet at one side of the washing apparatus, a drying chamber formed between the opening/closing part and the cabinet, and a heated air generating part generating heated air that is to be introduced to the drying chamber, the drying apparatus integrally formed with the washing apparatus.

The washing apparatus may be independently controlled from the drying apparatus.

The clothes treatment apparatus may further include a heated air generating part and a steam divergence part. The heated air generating part may be provided in the cabinet to generate steam. The steam divergence part may allow the steam generated from the steam generating part to be selectively supplied to one of the washing apparatus and the drying chamber.

In accordance with an aspect, a clothes treatment apparatus includes a washing apparatus including a cabinet having an opening formed at an upper side thereof, a first door configured to open and close the opening, and a washing chamber provided in the cabinet to perform a washing operation therein, wherein the laundry treatment apparatus may further include a second door provided separately provided from the first door, a drying chamber opened and closed by the second door and divided from the washing chamber, a chamber inlet provided at a lower side of the drying chamber to allow heated air or steam to be introduced to the drying chamber.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
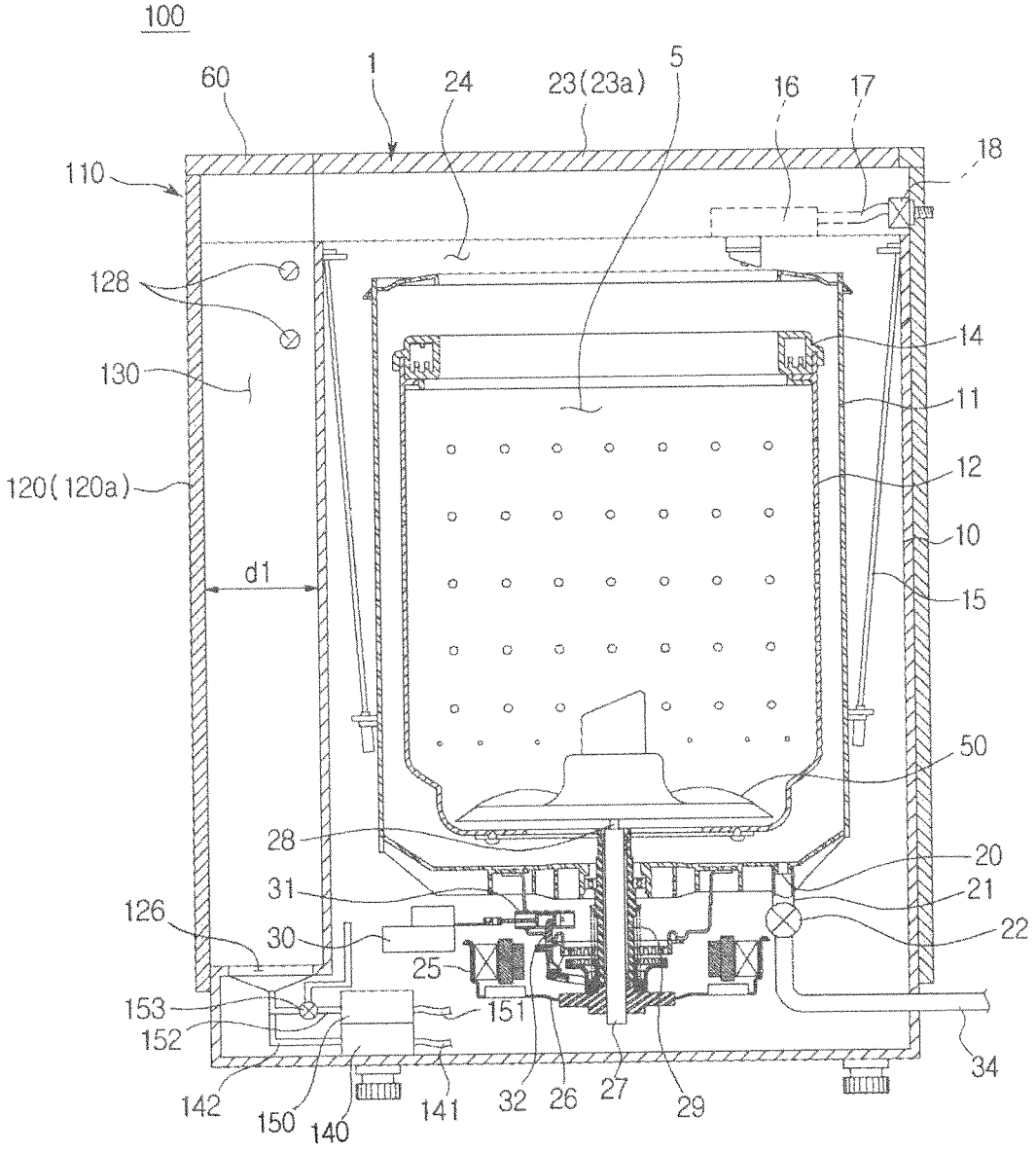
FIG. 1 is a drawing illustrating a clothes treatment apparatus in accordance with an embodiment.

Reference will now be made in detail to the embodiments, examples of which are illustrated in the accompanying drawings, wherein like reference numerals refer to like elements throughout.

Figure 2:
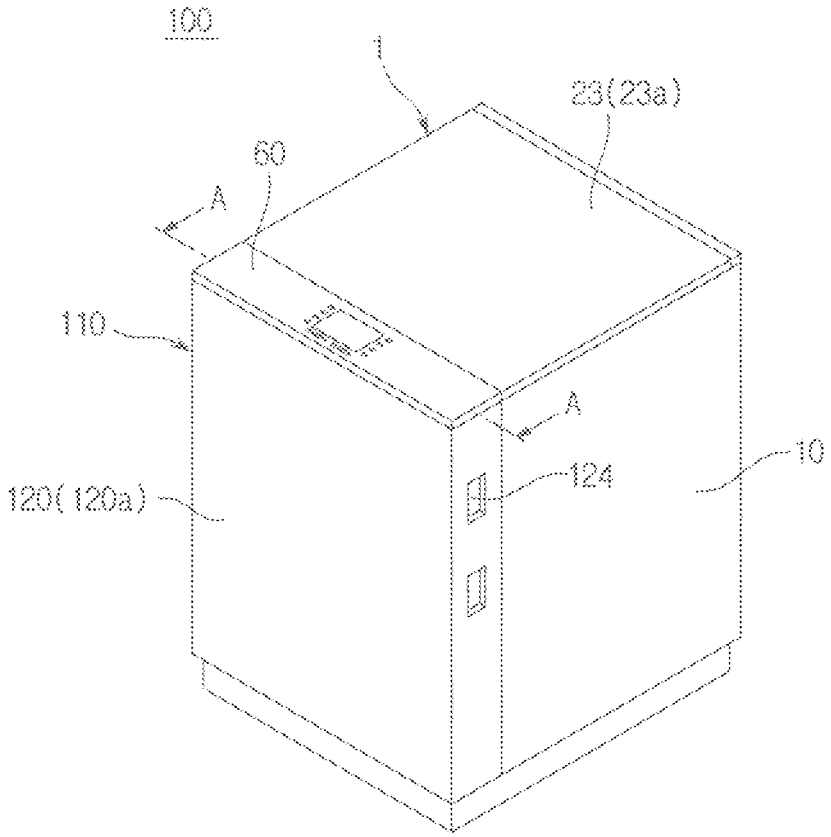
FIG. 2 is a perspective view illustrating the clothes treatment apparatus in accordance with an embodiment.
Figure 3:
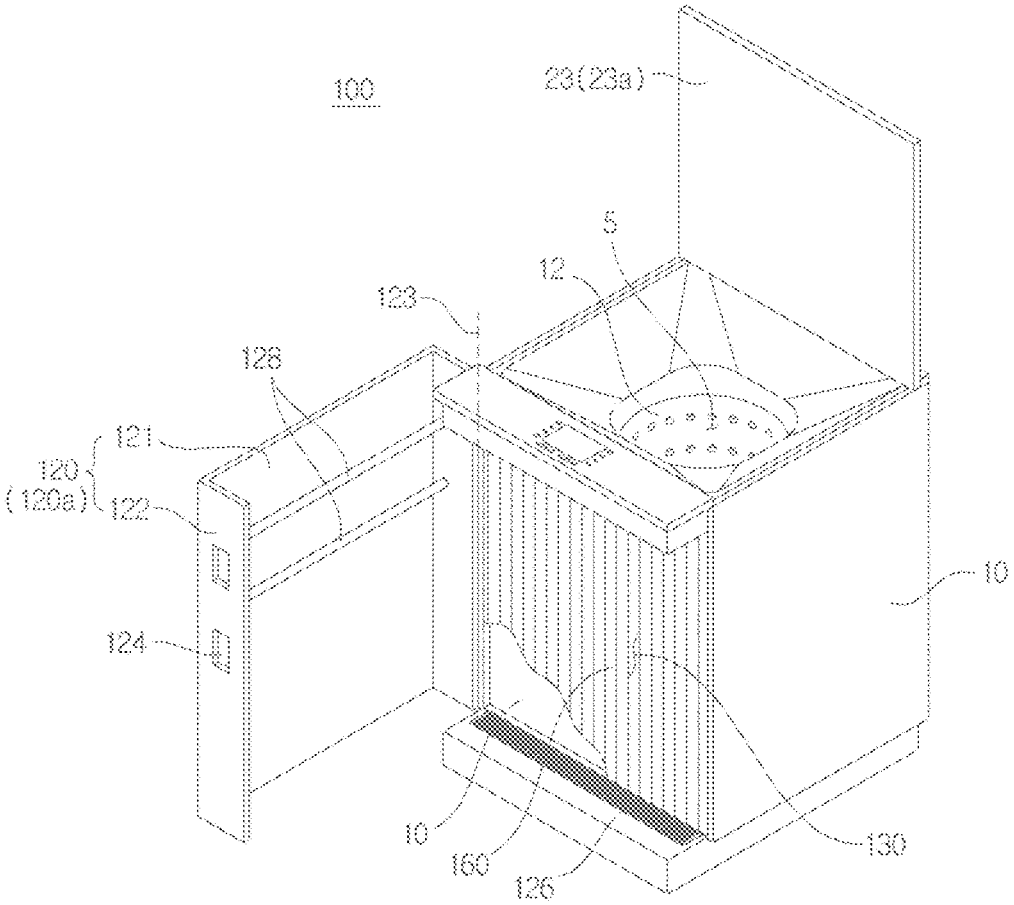
FIG. 3 is a drawing illustrating a door and an opening/closing part of the clothes treatment apparatus in accordance with an embodiment.

FIG. 1 is a drawing illustrating a clothes treatment apparatus in accordance with an embodiment, FIG. 2 is a perspective view illustrating the clothes treatment apparatus in accordance with an embodiment, and FIG. 3 is a drawing illustrating a state of having a door and an opening/closing part closed in the clothes treatment apparatus.

Referring to FIG. 1, a clothes treatment apparatus 100 represents an apparatus configured to wash or dry laundry, and includes a washing apparatus 1 and a drying apparatus 110.

The washing apparatus 1 includes a cabinet 10 forming an external appearance thereof, a fixed tub 11 provided in the cabinet 10 to store wash water, a rotary tub 12 rotatably disposed in the fixed tub 11, and a pulsator 50 disposed in the rotary tub 12 to generate a stream of water.

The cabinet 10 is provided at an upper portion thereof with an opening 24 allowing laundry to be input into the rotary tub 12. The opening 24 may be open and closed by a door 23 installed at the upper portion of the cabinet 10. The fixed tub 11 may be supported against the cabinet 10 through a suspension apparatus 15.

A water supply pipe 17 is installed at an upper side of the fixed tub 11 to supply wash water to the fixed tub 11. One side of the water supply pipe 17 is connected to an external water supply source, and the other side of the water supply pipe 17 is connected to a detergent supply apparatus 17. Water supplied through the water supply pipe 17 is supplied to the inside of the fixed tub 11 together with detergent via the detergent supply apparatus 16. A water supply valve 18 is installed on the water supply pipe 17 to control supply of water.

The rotary tub 12 is formed in the shape of a cylinder having an upper side thereof open. A plurality of through holes are formed through a side surface of the rotary tub 12. A balancer 14 is mounted at an upper side of the rotary tub 12 to stably rotate the rotary tub 12 at a high speed rotation.

The fixed tub 11 is provided at an outer lower side thereof with a motor 25 configured to rotate the rotary tub 12 and the pulsator 50, and a power conversion apparatus 26 simultaneously or selectively transmitting driving force generated from the motor 25 to the rotary tub 12 and the pulsator 50.

A dehydration shaft 29 having a hollow portion is coupled to the rotary tub 12, and a washing shaft 27 installed on the hollow portion of the dehydration shaft 29 is coupled to the pulsator 50 through a washing shaft coupling part 28. The motor 25 may transmit a driving force simultaneously or selectively to the rotary tub 12 and the pulsator 50 according to ascending/descending motion of the power conversion apparatus 26.

The power conversion apparatus 26 includes an actuator 30 generating a driving force for power conversion, a rod part 31 performing a linear motion according to operation of the actuator 30, and a clutch part 32 connected to the rod part 31 and pivoting according to operation of the rod part 31.

A drainage port 20 is formed at the bottom of the fixed tub 12 to discharge wash water stored in the fixed tub 12, and a first drainage pipe 21 is connected to the drainage port 20. A drainage valve 22 may be installed on the first drainage pipe 21 to regulate supply of water. An exit of the drainage valve 22 may be connected to a second drainage pipe 34 to discharge wash water to the outside.

The drying apparatus 110 may be provided at one side of the washing machine 1 as an integral part with the washing machine 1. In detail, the drying apparatus 110 may be integrally formed with one side surface of the cabinet 10. Although the following description will be made in relation that the clothes treatment apparatus 100 is provided with a top loading type washing apparatus 1 that includes the cabinet 10 having the opening 24 formed at an upper side thereof and the rotary tub 12 having a rotary shaft perpendicular to the bottom surface of the washing apparatus 1, the present disclosure is not limited thereto. For example, the present disclosure can be applied to a clothes treatment apparatus having a front loading type washing machine in which a front surface of the cabinet is open and closed.

The drying apparatus 110 and the washing machine 1 may be integrally formed with each other, and but independently controlled from each other through manipulation of a button part 60.

The drying apparatus 110 includes an opening/closing part 120, a drying chamber 130 and a heated air generating part 140.

The opening/closing part 120 is rotatably provided on the cabinet 10, and forms the drying chamber 130 that serves as a drying space to allow laundry to be put in between the opening/closing part 120 and the cabinet 10.

As for the clothes treatment apparatus 100 having the top loading type washing machine 1, the rotary tub 12 rotatably provided in the fixed tub has a shaft elongated in a vertical direction, and rotates on the shaft. The opening/closing part 120 has a hinge shaft 123 parallel to the shaft serving as a center of rotation of the rotary tub 12, and is rotatably coupled to the cabinet 10.

The shape of the opening/closing part 120 is not limited thereto as long as the opening/closing part 120 forms the drying chamber 130 together with the cabinet 10. Although the opening/closing part 120 is provided at each side portion thereof in the form of a flange, having a '⊏' shaped cross section to cover one side surface of the cabinet 10.

The opening/closing part 120 may be provided to cover at least one side surface of the cabinet 10. The opening/closing part 120 in accordance with an embodiment is provided at a front side surface of the cabinet 10 to cover the front side surface.

In detail, the opening/closing part 120 may include a main cover part 121 and separate cover parts 122.

The main cover part 121 forms one surface parallel to the one side surface of the cabinet 10 and is spaced apart from the one side surface of the cabinet 10 by a first distance dl to allow laundry to be put between the main cover part 121 and the cover part 10.

The separate cover parts 122 are provided to be bent from both sides of the main cover part 121 toward the cabinet 10, and configured to allow the main cover part 122 to be spaced apart from the cabinet 10 by the first distance dl. The first distance dl is not limited thereto, and depending on the capacity and size of the washing apparatus 1, may vary with a space for drying laundry.

In addition, although the opening/closing part 120 in accordance with an embodiment is provided with the configuration of the separate cover part 122 to maintain the distance between the main cover part 121 and the cabinet 10, the present disclosure is not limited thereto. For example, the configuration of the separate cover part 122 may be provided on the cabinet 10, and only the main cover part 121 may be rotatably provided on the cabinet 10.

The opening/closing part 120 is provided at one side thereof facing the cabinet 10 with a laundry rest 128 on which laundry is put. Laundry to be dried is put on the laundry rest 128, and as the opening/closing part 120 is coupled to the cabinet 120 by rotation, the opening/closing part 120 and the cabinet 10 form the drying chamber 130, so that the laundry is disposed in the drying chamber 130.

The opening/closing part 120 is provided at one end thereof with a hinge shaft allowing the opening/closing part 120 to be pivoted at one side of the cabinet 10.

The opening/closing part 120 is separately provided from the door 23, and the door 23 allowing laundry to be input/withdrawn into/from the washing apparatus 1 therethrough is open and closed separately from the opening/closing part 120 allowing laundry to be input/withdrawn into/from the drying apparatus 110 therethrough. In this configuration, even when the washing apparatus 1 is in the process of a washing operation, laundry may be dried in the drying apparatus 110.

The drying chamber 130 is a space in which laundry is dried, and is provided at one side of the washing apparatus 1.

The drying chamber 130 is configured to be surrounded by one side surface of the cabinet 10 and inner surfaces of the opening/closing part 120 facing the cabinet 10, so that laundry to be dried is disposed in the drying chamber 130. In a different point of view, a washing chamber serving as a washing space, in which laundry is washed and which includes the fixed tub 11 and the rotary tub 12, is divided by the cabinet 10 from the drying chamber 130 in which laundry is dried.

The drying chamber 130 may be directly divided by the cabinet 10 from the washing chamber 5, and alternatively, a chamber insulating member 160 may be provided between the washing chamber 5 and the drying chamber 130 to prevent heat generated from the drying chamber 130 from exerting an influence on the washing chamber 5.

The chamber insulating member 160 may be provided between the drying chamber 130 and the washing chamber 5, and alternatively, provided on the opening/closing part 120 to prevent heat generated from the inside of the drying chamber 130 from exerting an influence on the outside.

The drying chamber 130 is provided at a lower side thereof with a chamber inlet 126 communicating with the heated air generating part 140 or a steam generating part 150, to supply heated air or steam to the inside of the drying chamber 130.

In addition, a chamber outlet 124 is provided at a portion of the opening/closing part 120 corresponding to a side portion of the drying chamber 130, to discharge air that is damp by absorbing moisture of laundry in the drying chamber 130 to the outside of the clothes treatment apparatus 100. In order to improve the drying efficiency or steam sterilization efficiency in the drying chamber 130, the chamber outlet 124 is provided to have an area smaller than that of the chamber inlet 126.

The heated air generating part 140 is configured to generate dry air that is to be introduced into the drying chamber 130. The position and shape of the heated air generating part 140 is not limited, the heated air generating part 140 is provided in the washing apparatus 1.

The heated air generating part 140 may be provided with an inlet port 141 allowing air to be introduced therethrough, to generate dry air, and one end of the inlet port 141 may be provided in the washing apparatus 1 or may communicate with outside of the washing apparatus 1 to suction air. The dry air generated from the heated air generating part 140 is introduced into the drying chamber 130 through the chamber inlet 126 after passing through a drying duct 142.

The drying apparatus 110 may further include the steam generating part 150.

The steam generating part 150 is configured to generate steam that is introduced into the drying chamber 130. The position and shape of the steam generating part 150 is not limited, the steam generating part 150 is provided in the washing apparatus 1 to generate steam. In detail, the fixed tub 11 having a cylindrical shape is disposed in the cabinet having a square pillar shape, and the heated air generating part 140 and the steam generating part 150 are disposed in a space where the fixed tub 11 is not disposed, thereby enhancing the spatial efficiency.

The steam generating part 150 may include a steam water supply pipe 151 that diverges from the water supply pipe 17 or is connected to an external water supply source to receive water required for steam generation, and a steam discharge pipe 152 that discharges steam generated from the steam generating part 150.

Steam generated from the steam generating part 150 may be introduced only to the inside of the drying chamber 130 of the drying apparatus 100, and alternatively, may be controlled even to be introduced into the inside of the rotary tub such that steam is sprayed toward laundry for steam sterilization in the washing apparatus 1.

In detail, a steam divergence part 153 is provided on the steam discharge pipe 152, and through control of the steam divergence part 153, the generated steam is selectively introduced into the drying chamber 130 or the rotary tub.

According to manipulation of a control apparatus (not shown), the steam divergence part 153 may be directly manipulated. Alternatively, the steam discharge pipe 152 is provided in plural that respectively extend from the steam generating part 150 to the chamber inlet 126 and the rotary tub such that according to manipulation of the steam generating part 150, steam is selectively sprayed.

Hereinafter, the clothes treatment apparatus 100 in accordance with the present disclosure will described in a different point of view, and details of configurations identical to those of the above description will be omitted.

With the clothes treatment apparatus 100 provided with a washing apparatus 1 in a top loading type that includes a cabinet having an opening 24 formed at an upper side thereof and a first door **23*a* configured to open and close the opening 24, the clothes treatment apparatus 100 includes a drying apparatus 110 having a second door 120*a* at least one portion of which is spaced apart from the cabinet by a first distance dl to put laundry therebetween and which is rotatable in a direction perpendicular to rotation direction of the first door 23*a* at one side surface of the cabinet, a drying chamber 130 formed between the second door 120*a* and the cabinet 10, and a chamber inlet 126 provided at a lower side of the drying chamber 130 to introduce heated air or steam to the drying chamber 130**.

The first door 23*a* is configured to open and close the opening 24 of the cabinet, and the second door 120*a* is configured to form the drying chamber 130 through rotation at the drying apparatus 110.

The first door 23*a* and the second door 120*a* are provided to rotate in respective directions that are perpendicular to each other. Even when laundry is input or withdrawn into/from the inside of the cabinet through the first door 23*a*, laundry may be placed or withdrawn on/from the drying chamber 130 through the second door 120*a*. The first door 23*a* and the second door 120*a* are provided to be open and closed independently from each other.

Hereinafter, an operation of the clothes treatment apparatus having the above configuration will be described.

Laundry desired to be washed is introduced into the rotary tub 12 through the opening 24 of the cabinet 10, and wash water mixed with detergent is introduced into the rotary tub 12 by supplying water. As a control involving a washing process is performed through manipulation of the button part 60, the rotary tub 12 is rotated to perform a washing process.

The drying operation of the drying apparatus 100 is controlled independent of the washing operation.

The opening/closing part 120 of the drying apparatus 100 is open to put laundry on the laundry rest 128, and then is rotated to be coupled to the cabinet 10.

Figure 4:
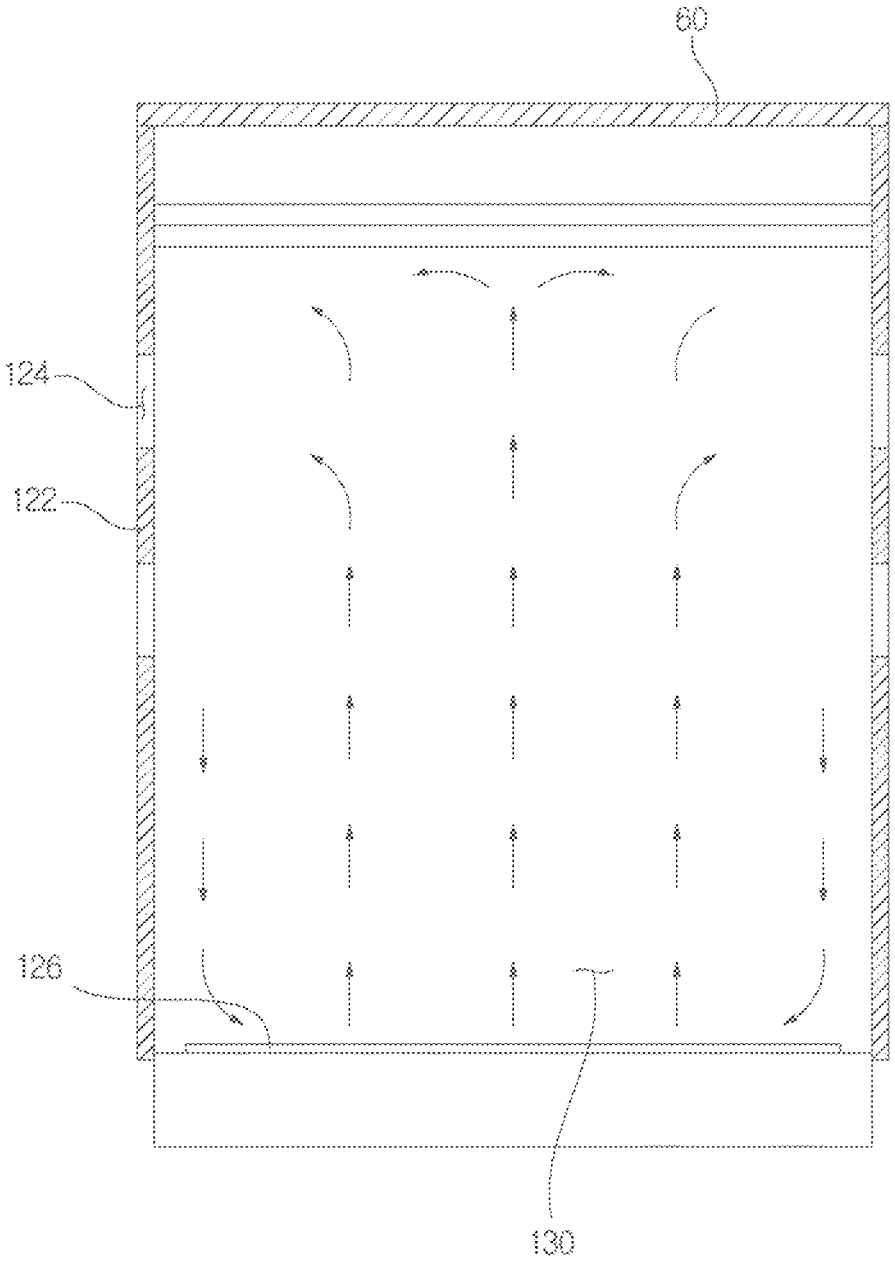
FIG. 4 is a cross sectional view taken along line A-A' of FIG. 2.

As the drying process is controlled through manipulation of the button part 60, heated air is generated from the heated air generating part 140 provided in the cabinet 10 and is introduced to the inside of the drying chamber 130 through the chamber inlet 126. In addition, as damp air containing moisture absorbed from laundry is discharged through the chamber outlet 124, dry air is circulated to dry the laundry in the drying chamber 130 as shown in FIG. 4.

Separately from the above control, steam generated from the steam generating part 150 is provided to be selectively sprayed to the drying chamber 130 or the rotary tub 12, such that the laundry is subject to steam sterilization in the drying chamber 130 and the rotary tub 12. The introduction of heated air to the drying chamber 130 may be independently achieved from the introduction of steam to the drying chamber 130, or may be simultaneously achieved with the introduction of steam of the drying chamber 130.

In this process, the washing apparatus 1 and the drying apparatus 110 spatially separated from each other are simultaneously controlled and thus rapid treatment of clothes is ensured. In addition, the washing apparatus 1 and the drying apparatus 110 can be separately controlled from each other, and thus the washing efficiency and the drying efficiency are improved.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. A clothes treatment apparatus comprising:

a washing apparatus comprising a cabinet having an opening formed at a top side thereof, a door configured to open and close the opening, a fixed tub provided in the cabinet to store wash water and a rotary tub rotatably provided in the fixed tub to accommodate laundry therein, to perform a washing process; and a drying apparatus comprising:

a drying chamber provided on a front side of the cabinet to accommodate laundry, an inlet port located in the cabinet and having one end open to the washing apparatus or an outside of the washing apparatus to input air, an air passage allowing the input air to the drying chamber, and an opening/closing part to open or close the drying chamber, the opening/closing part having a rotational axis perpendicular to a rotational axis of the door.

2. The clothes treatment apparatus of claim 1, wherein the washing apparatus is independently controlled from the drying apparatus.

3. The clothes treatment apparatus of claim 1, wherein the opening/closing part is disposed at a front side of the drying chamber.

4. The clothes treatment apparatus of claim 3, wherein the opening/closing part comprises:

a main cover part provided to face a front surface of the cabinet while the opening/closing part closes the drying chamber; and spaced cover parts bent from both sides of the main cover part toward the cabinet.

5. The clothes treatment apparatus of claim 1, further comprising:

a steam water supply pipe in the cabinet to supply water to generate a steam, a steam discharge pipe in the cabinet to discharge the generated steam, and a steam divergence inlet allowing the steam discharged by the steam discharge pipe to be input, and at least one steam divergence outlet allowing the steam input to the steam divergence inlet to be selectively supplied to one of the washing apparatus and the drying chamber.

6. The clothes treatment apparatus of claim 1, wherein the drying apparatus comprises:

a chamber inlet provided at a lower side of the drying chamber to allow heated air to be introduced to the drying chamber; and a chamber outlet provided at the opening/closing part to discharge the heated air that is introduced through the chamber inlet to the outside.

7. The clothes treatment apparatus of claim 1, wherein the drying apparatus comprises a chamber insulating member disposed between the cabinet and the drying chamber to prevent heat from transmitting to the cabinet.

8. The clothes treatment apparatus of claim 1, wherein the drying chamber is formed by a plurality of surfaces of the opening/closing part and a front surface of the cabinet.

9. The clothes treatment apparatus of claim 1, wherein the drying chamber is divided by the cabinet from a washing space in which a washing operation is performed by the washing apparatus.

10. A clothes treatment apparatus comprising:

a washing apparatus comprising a cabinet having an opening formed at a top side thereof, a door configured to open and close the opening, a fixed tub provided in the cabinet to store wash water and a rotary tub rotatably provided in the fixed tub to accommodate laundry therein; and a drying apparatus comprising:

an opening/closing part rotatably coupled to the cabinet at one side of the washing apparatus that is perpendicular to the top side of the cabinet, a drying chamber formed between the opening/closing part of the drying apparatus and the cabinet, and an inlet port having one end open to the washing apparatus or an outside of the washing apparatus allowing air to be introduced and an outlet to provide the introduced air to the drying chamber, the drying apparatus integrally formed with the washing apparatus.

11. The clothes treatment apparatus of claim 10, wherein the washing apparatus is independently controlled from the drying apparatus.

12. The clothes treatment apparatus of claim 10, further comprising:

a steam water supply pipe in the cabinet to supply water to generate a steam, and a steam discharge pipe in the cabinet to discharge the generated steam, a steam divergence inlet allowing the steam discharged by the steam discharge pipe to be input, and at least one steam divergence outlet allowing the steam input to the steam divergence input to be selectively supplied to one of the washing apparatus and the drying chamber.

13. A clothes treatment apparatus comprising;

a washing apparatus comprising:

a cabinet having an opening formed at a top side thereof, a first door configured to open and close the opening, and a washing chamber provided in the cabinet to perform a washing operation therein; and a second door provided separately provided from the first door on a side of the clothes treatment apparatus that is perpendicular to the top side;

a drying chamber opened and closed by the second door and divided from the washing chamber including a space to allow a laundry to be put in between the second door and the washing chamber; and a chamber inlet provided at a lower side of the drying chamber to allow air to be introduced to the drying chamber.

* * * * *